US007463836B2

(12) United States Patent
Able et al.

(10) Patent No.: US 7,463,836 B2
(45) Date of Patent: Dec. 9, 2008

(54) SYSTEM, METHOD AND PRINT CARTRIDGE FOR SIGNALING USER REPLACEMENT OF FUSER WIPER

(75) Inventors: Douglas Anthony Able, Shelbyville, KY (US); Thomas Neal Barnes, Versailles, KY (US); Patrick O. Bischel, Paris, KY (US); Rickey Carter Brown, Bardstown, KY (US); William Keith Richardson, Salvisa, KY (US); Louann Behymer Samuels, Lexington, KY (US); Kevin Dean Schoedinger, Lexington, KY (US); Gregory Scott Tigges, Frankfort, KY (US)

(73) Assignee: Lexmark International Inc, Lexington, KY (US)

( * ) Notice: Subject to any disclaimer, the term of this patent is extended or adjusted under 35 U.S.C. 154(b) by 5 days.

(21) Appl. No.: 11/133,523

(22) Filed: May 20, 2005

(65) Prior Publication Data

US 2006/0263105 A1 Nov. 23, 2006

(51) Int. Cl.
*G03G 15/00* (2006.01)

(52) U.S. Cl. ..... 399/24; 399/12

(58) Field of Classification Search ..... 399/24, 399/12, 33

See application file for complete search history.

(56) References Cited

U.S. PATENT DOCUMENTS

| | | | | |
|---|---|---|---|---|
| 4,961,088 | A * | 10/1990 | Gilliland et al. | 399/25 |
| 5,142,340 | A | 8/1992 | Farrell et al. | |
| 5,452,065 | A | 9/1995 | Bell | |
| 5,634,169 | A | 5/1997 | Barry et al. | |
| 6,487,389 | B2 | 11/2002 | Jia et al. | |
| 6,643,475 | B2 | 11/2003 | Hoberock et al. | |
| 6,876,832 | B2 | 4/2005 | Pirwitz et al. | |
| 2003/0095278 | A1 * | 5/2003 | Schwartz et al. | 358/1.14 |
| 2004/0257609 | A1 * | 12/2004 | Tokimatsu | 358/1.15 |
| 2006/0039708 | A1 * | 2/2006 | Doty et al. | 399/24 |

* cited by examiner

*Primary Examiner*—David M. Gray
*Assistant Examiner*—David A Blackshire

(57) ABSTRACT

A printing device (10) such as a laser printer includes a fuser assembly (200) with a fuser wiper (210) that can be removed and replaced by a user during normal maintenance to extend the useful life of the fuser assembly (200). Indicators (b0, b1) stored in a memory device (144) can be read by a print engine (36) of a printer (10) either when a print cartridge (100) is first inserted into the printer (10) or at specified times thereafter. Depending on the contents of the memory device (144), the print engine (36) may send a notification message to the printer's raster image processor (150) to cause a message to be displayed on the printer's operational/display panel (254) that informs a user the fuser wiper (210) should be replaced.

3 Claims, 4 Drawing Sheets

SYSTEM, METHOD AND PRINT CARTRIDGE FOR SIGNALING USER REPLACEMENT OF FUSER WIPER

TECHNICAL FIELD

Specific embodiments relate to methods of signaling user replacement of a fuser wiper within an image forming device such as a laser printer. Still more particularly, the invention relates to the storing of information within a print cartridge that is used by a print engine in order to cause a notification message to be generated informing a user that the fuser wiper should be replaced.

BACKGROUND OF THE INVENTION

Inkjet and laser printers have become commonplace equipment in most workplace and home computing environments. Today, many printers are multi-functional sophisticated image forming devices capable of printing on a large array of recording media such as standard letterhead and paper envelopes as well as a host of specialized media. At the same time, printers have become more reliable and require less overall service, maintenance and repair than earlier models. Yet, the requirement for routine service and maintenance of certain essential printer components remains.

In an electrophotographic (EP) printer, unfused toner particles are electrostatically attracted to the media to form an image. In order for the image to be fixed permanently the media must be fused. A fuser combines high temperature and pressure to the toner until it is melted and forced to adhere to the media. As such, the fuser is a critical component in the overall image forming process of most EP image forming devices.

It is well known that a printer's fuser is subject to disrepair and/or failure due to lack of service. Some printer manufacturers report having to honor a relative large amount of warranty claims directly related to the fuser assembly. Most such claims can be directly traced to a lack of care on behalf of the customer who fails to take preventative measures to increase the fuser's life. Furthermore, it is known that many fuser failures can be attributed to the use of special media which can reduce the fuser's service life. In the case of special media, it may be necessary for the customer to service the fuser more often than when printing on normal media stock. Yet, in many cases the user forgets to service the fuser at recommended intervals or may not readily appreciate how the media he/she uses may be reducing fuser life.

As such, a means of extending the fuser's life and thereby also reducing warranty claims based on the disrepair or failure of a printer's fuser would be advantageous.

BRIEF DESCRIPTIONS OF THE DRAWINGS

The accompanying drawings incorporated in and forming a part of the specification illustrate several aspects of the present invention and together with the description and claims serve to explain the principles of the invention. In the drawings:

DETAILED DESCRIPTION

For simplicity the discussion below will use the terms "media", "sheet" and/or "paper" to refer to a discrete unit of recording media. It should be understood, however, that this term is not limited to paper sheets, and any form of discrete recording media is intended to be encompassed therein, including without limitation, envelopes, transparencies, postcards, labels, special media and the like.

Figure 1:
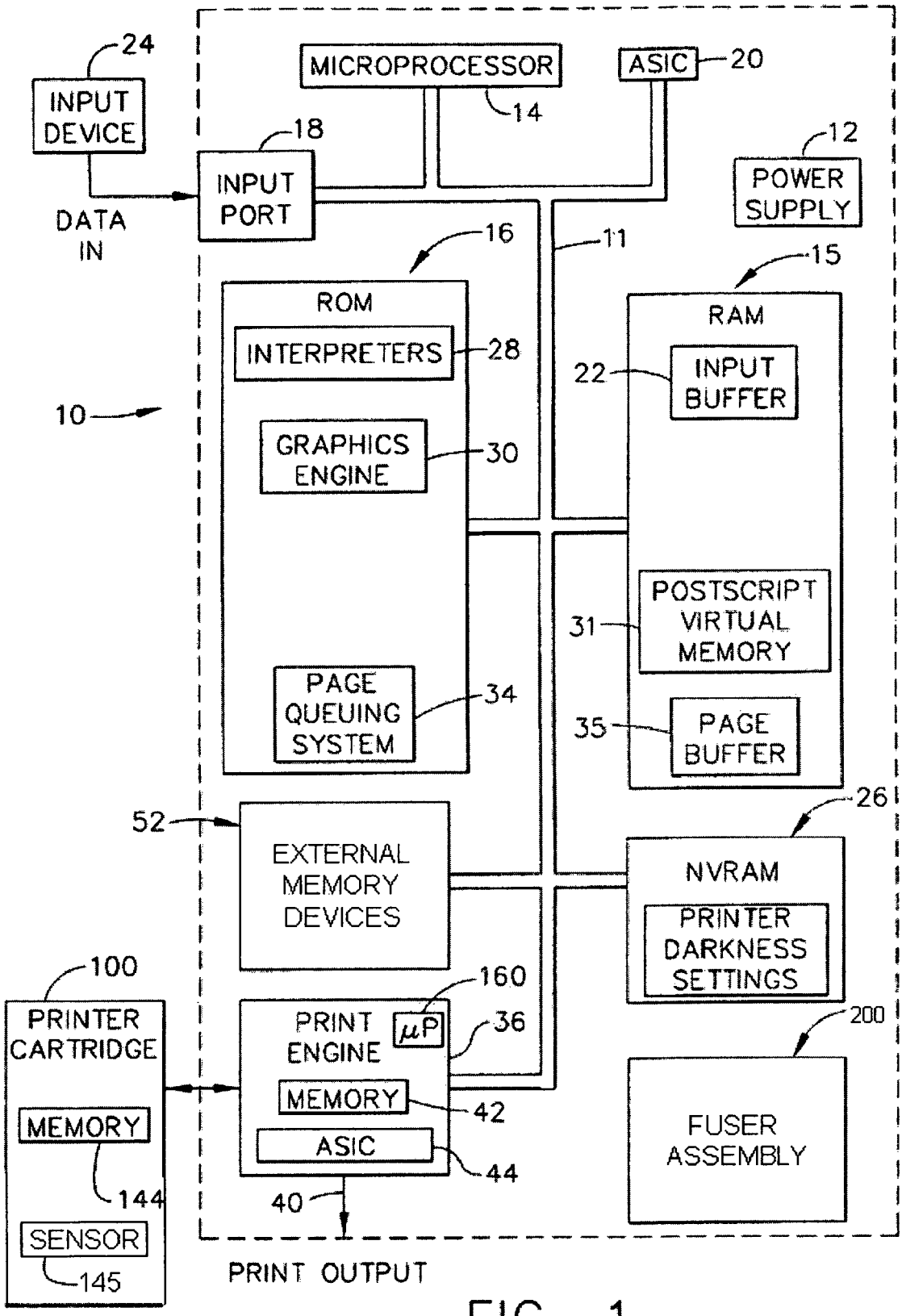
FIG. 1 is a block diagram of the major components of a printer, as constructed according to the principles of the present invention.

Referring now to the drawings, FIG. 1 shows a hardware block diagram of a laser printer generally designated by the reference numeral 10, although virtually the same components will be found on many ink jet printers. Laser printer 10 will preferably contain certain relatively standard components, such as a DC power supply 12 which may have multiple outputs of different voltage levels, a microprocessor 14 having address data lines, and control and/or interrupt lines, Read Only Memory (ROM) 16, and Random Access Memory (RAM) 15, which is divided by software operations into several portions for performing several different functions. Furthermore, an NVRAM memory at 26 is typically provided in such systems. The external memory device designated by the reference numeral 52 may be an option on many if not most laser printers, in which a hard disk drive and/or a Flash memory device 52 can be added to the base printer upon the request of the user/customer. Such alternative storage memory devices also will likely appear in top-line ink jet printers.

Laser printer 10 also contains at least one input port, or in many cases several types of input ports, as designated by the reference numeral 18. Each of these ports would be connected to a corresponding input buffer, generally designated by the reference numeral 22 on FIG. 1. Each port 18 would typically be connected (a) to an output port of either a personal computer (PC) or a workstation (WS) (designated on FIG. 1 as an "input device" 24) that would contain a software program such as a word processor or a graphics package or computer aided drawing package, or (b) to a network that could be accessed by such a PC or WS. Laser printer 10 may also contain an Application Specific Integrated Circuit (ASIC) 20, which typically contains a large number of logic circuits.

Once text or graphical data has been received by input buffer 22, it is commonly communicated to one or more interpreters designated by the reference numeral 28. A common interpreter is PostScript™, which is an industry standard used by many laser printers. To speed up the process of rasterization, a font pool and typically also a font cache may be stored in memory within most laser printers. Such font pools and caches supply bitmap patterns for common characters so that a graphics engine 30 can easily translate each such character into a bitmap using a minimal elapsed time.

Once the data have been rasterized, they are directed by a page queuing system 34 into a page buffer, which is a portion of RAM designated by the reference numeral 35. In a typical laser printer, an entire page of rasterized data is temporarily stored by the page queuing system 34 in the page buffer 35, although some of the more modern laser printers do not buffer an entire page's worth of data at one time, thereby managing to operate with a much smaller amount of RAM in a "partial page buffer." The data within the page buffer 35 may be communicated in real time to a print engine designated by the reference numeral 36. Print engine 36 typically includes a laser light source (not shown) within its printhead, and its output 40 is the physical printing onto a piece of paper, which is the final print output from laser printer 10. Print engine 36 also may contain a programmable non-volatile memory device 42, in addition to registers contained within its ASIC 44 that may act as either RAM or ROM, as desired. Programmable memory device 42 could consist of a Flash type-device, or an NVRAM-type device, for example, or any other type of non-volatile memory device.

Still referring to FIG. 1, it will be understood that the address, data, and control lines are typically grouped in buses, which are electrically conductive pathways that are physically communicated in parallel (sometimes also multiplexed) around the various electronic components within laser printer 10. For example, the address and data buses may be sent to all ROM and RAM integrated circuits, and the control lines or interrupt lines directed to all input or output integrated circuits that act as buffers. For ease of illustrating the present invention, the various buses used within printer 10 are grouped on FIG. 1 into a single bus pathway, designated by the reference numeral 11.

A portion of the RAM 15 is typically allocated for virtual memory for at least one interpreter, and on FIG. 1 a POSTSCRIPT virtual memory is depicted at the reference numeral 31. This virtual memory 31 can be used, for example, for storing PostScript font descriptors within the printer. In addition, particularly important information that is to be retained in printer 10 while unpowered may be stored in a quickly accessible non-volatile memory location called "NVRAM," which is designated by the reference numeral 26. This non-volatile RAM is most likely (using today's technology) an EEPROM integrated circuit chip.

The print cartridge, generally designated by the reference numeral 100, is used in typical printing devices available at the present time. For laser printers (or other types of electrophotographic printing devices), reference numeral 100 represents a replaceable EP print cartridge that contains toner material, as well as a photoconductive drum unit 132 (see FIG. 2) supplied in most such EP print cartridges. The EP print cartridge typically contains black toner material for monochrome laser printers, and at least three different toner materials for color laser printers (for the standard "process" colors of cyan, magenta, and yellow- and possibly black), although multi-color EP printers and copiers are also available that use multiple individual toner cartridges that each contain only a single color of toner material. Whether or not a black toner cartridge- or a black toner "bay" of a multi-color EP print cartridge—is included for the particular printer or copier is a matter of design choice.

Laser printer 10 also includes a fuser assembly 200 which is used in an electrophotographic machine, such as laser printer 10, to fuse previously applied toner particles onto a surface of a print medium, such as paper. Typically, the fuser assembly 200 includes a fuser roll which presses the toner into the print medium. Also, the fuser roll is typically heated internally by a heating element, such as a fuser lamp, disposed therein.

Of course, certain printer-specific information as well the process logic for the print engine 36 may be stored within the programmable memory device 42. For example, according to the present invention, programmable memory device 42 may be used to store print engine code for implementing a "replace fuser wiper message" function, or similar operation, as described herein. As discussed in more detail below, printer logic within the image forming device, such as laser printer 10, may cause a notification message to be generated based on the information stored on the print cartridge 100, which is accessible by the print engine 36. Such printer logic may be contained within memory device 42 such that a notification message may be generated that indicates to a user that a fuser wiper should be replaced at some specified point in the print cartridge's life.

Some conventional EP print cartridges contain a non-volatile memory device, such as an EEPROM chip or an EPROM chip or other similar storage means. For purposes of the present invention, the cartridge 100 contains a non-volatile memory device 144 or memory chip that is programmable. Programmable memory device 144 could consist of a Flash type-device, or an NVRAM-type device, for example, or any other type of non-volatile memory device. According to one embodiment of the present invention, memory device 144 is used to store print cartridge status information which can be accessed by the print engine 36 and which is used to enable a "replace fuser wiper message" function to notify a user that it is time to replace the fuser wiper. Likewise, programmable memory device 42 may be used to store print engine code for implementing a "replace fuser wiper message" function, or similar operation, depending on what has been stored in memory device 144. Printer logic within the memory device 42 or elsewhere within printer 10 may then cause a notification message to be generated based on the information stored on the print cartridge 100. Thus, a notification message indicating to a user that a fuser wiper should be replaced at some specified point in the print cartridge's life may then be generated. It is contemplated that the print cartridge 100 would support such a function and, if not, that the printer logic and print engine 36 would still work (minus the "replace fuser wiper message" function) in printers that do not contain a cartridge supporting the "replace fuser wiper message" function.

It may be useful to be able to update some of the stored information contained in this memory device 144. One way of implementing such a "replace fuser wiper message" function may involve dedicating a portion of the memory device 144 to store status indicators about the print cartridge 100 at the time of manufacture and during use. For example, bit locations within the memory device 144 may be reserved to enable or disable the "replace fuser wiper message" function. One bit may be used to indicate the beginning of life of the print cartridge 100 such as when the cartridge 100 is first inserted into the printer 10. Additional bits may be used to indicate specified points in the cartridge's life when the fuser wiper should be replaced. Each of these bits may be programmed during cartridge manufacturing depending upon the cartridge configuration. Once the print engine 36 sends the notification, the bit for that specific point in life may be changed by the print engine to keep the notification from being sent again until the next time the fuser wiper should be replaced.

The capacity of the print cartridge 100 may also be specified in the memory device 144 and used by the print engine 36 to help determine the specified points to send the message. In this regard, it should be understood that specified time intervals for replacing the fuser wiper can depend on a variety of factors and the choice of timing may be left to the discretion of the individual cartridge manufacturer. For example, the specified interval for replacing the fuser wiper may be related to the amount of toner remaining in the print cartridge 100. If so, a sensor 145 may be used to help determine how much toner remains in the print cartridge 100 and the information may be communicated to print engine 36. Alternatively, the specified interval for replacing the fuser wiper may be related to the type of media being sent through the printer 10 which may reduce the fuser's life. (For example, it is known that labels with adhesive have a tendency to reduce fuser life.) Still other considerations may involve the number of image forming operations performed since the fuser wiper was last replaced, the type of print cartridge, the cartridge yield and the type of printer, as well as other factors. It should be understood that the invention should not be limited by any particular factor or set of factors used in determining the specified intervals for replacing the fuser wiper.

Other types of data could also be stored on the memory device 144, such as "usage" data. In many situations, such "usage" data will preferably be stored in a manner that cannot later be modified. This is a circumstance where the use of a write once-read often memory device could be used to advantage to track certain parameters relating to the usage history of this particular EP print cartridge 100. Moreover, programmable memory device 144 could be provided as a hybrid chip, such that a first portion is programmable multiple times by the printer, and that a second portion is only programmable once (thereby functioning as the write once-read often memory device described above).

Figure 2:
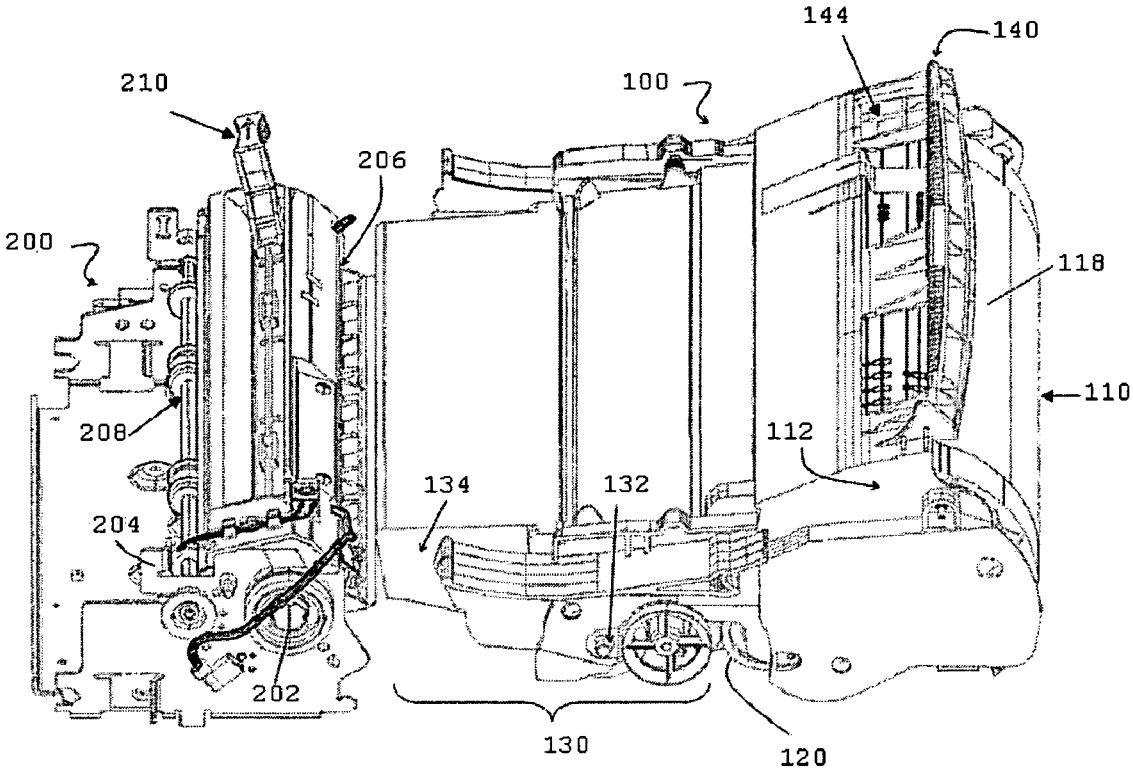
FIG. 2 is a perspective view of a removable print cartridge and a fuser assembly according to the principles of the present invention.

Referring to FIG. 2, a removable print cartridge 100 is shown along side a fuser assembly 200 in more detail. Print cartridge 100 is typically configured in a printer, such as laser printer 10, so that some of the main consumable or wearing components of the printer can be replaced in a unitary structure. Essentially, print cartridge 100 includes two major sub-assemblies, designated by the reference numerals 110 and 130. Sub-assembly 110 contains the toner reservoir and developer unit, whereas sub-assembly 130 contains the photoconductive (PC) drum 132 and the cleaner reservoir 134.

The toner/developer sub-assembly 110 depicted on FIG. 2 includes a toner housing 118 and toner reservoir 112 in which is typically found a toner paddle wheel (not shown). The developer unit 120 resides within the sub-assembly 110 and typically includes a developer roller, a doctor blade and other structures well known to those of ordinary skill in the art. During printing, toner material leaves the reservoir 112 and enters the developer unit 120 where the toner material is evenly spread across the width of a roller within the developer unit 120. At that point, the toner material is in proper condition to come into contact with the photoconductive drum 132.

The cleaner housing sub-assembly 130 includes a cleaner reservoir 134, a PC drum 132, a cleaner wiper, and other internal components well known in the industry. The cleaner housing sub-assembly 130 extends to the right and above the toner/developer sub-assembly 110 such that a portion of the cleaner housing sub-assembly (at the reference numeral 140) will approach an internal portion of the main body of printer 10. This portion 140 that extends to the main body of the printer may include at least one memory device 144 that is arranged to make electrical contact with the circuits of the main printer body. In one embodiment, memory device 144 comprises a non-volatile memory device that, as described above, may be used to store information relating to printer 10 and print cartridge 100.

Fuser assembly 200 receives media with toner deposited thereon from the print cartridge 100 and applies heat and pressure to fuse the toner to the media and create a permanent image. In general, fuser assembly 200 uses a fuser hot roll 202 which, as shown, may be mounted directly onto a fuser frame 204. The print media (not shown) travels into a nip 206 between the fuser hot roll 202 and a pressure roll (not shown), and exits through a second nip (not shown) between a pair of exit rollers 208. Exit rollers 208 may be rotated at a somewhat greater linear velocity so as to produce a slight tension on the print media. This is also referred to as an "overdrive" configuration.

A fuser wiper 210 is provided for routine cleaning of the fuser hot roll 202 in order to remove undesired remnants from the fusing operation that could interfere with subsequent proper operation of the fuser assembly 200 and/or reduce print output quality. This problem is well known in the arts. Typically, fuser wiper 210 is an item that a user can easily remove and replace as part of normal maintenance to extend the life of the fuser assembly 200. However, it has been found that users of a printer having a print cartridge with a replaceable fuser wiper, such as fuser wiper 210, do not always replace them at recommended intervals, leading to reduced life of the fuser assembly 200. The present invention provides a means of generating a notification message to users that the fuser wiper 210 should be replaced.

Figure 3:
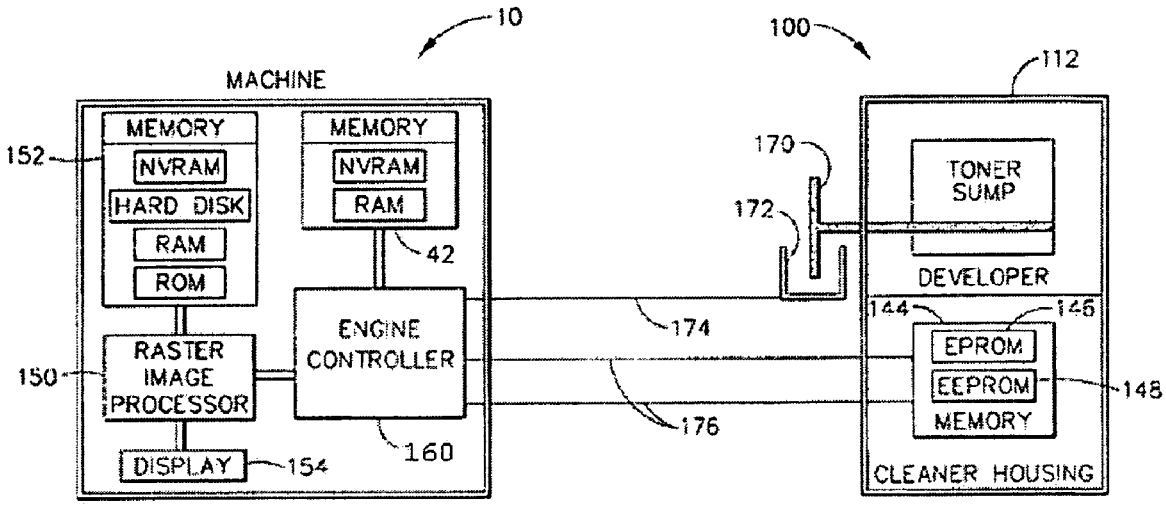
FIG. 3 is a block diagram illustrating some of the major components of a printer and how it interfaces with a print cartridge.

To better understand the present invention, reference is made to FIG. 3 which presents a block diagram of some of the major components of the printer, such as printer 10, and how they interface with the print cartridge 100. In particular, printer 10 is shown to include a raster image processor (RIP) 150 in communication with an engine controller 160. The raster image processor 150 includes the microprocessor 14 (see FIG. 1), and also performs certain functions such as the rasterizing function performed by the graphics engine 30 (see FIG. 1). Raster image processor 150 will also be referred to herein as the "RIP" 150, and it interfaces via electrical buses to memory devices, such as depicted on FIG. 3 by the reference numeral 152. As can be seen on FIG. 3, the memory device 152 includes (but is not limited to) RAM, ROM, and NVRAM, which roughly correspond to the RAM 15, ROM 16, as well as the NVRAM 26 on FIG. 1.

The RIP 150 also is in communication with a display 154, which preferably comprises a liquid crystal display that can show alphanumeric characters, as are commonly seen on laser printers. The RIP 150, using its programming located in the ROM and data located in its RAM and NVRAM, will control the information depicted on the display 154, and will also control the data flow to and from the engine controller 160.

The engine controller 160 may be part of the print engine 36 (see FIG. 1), and, if so, may be configured to communicate with its own set of RAM and NVRAM, designated by reference numeral 42 (see FIG. 1). It is possible for the NVRAM and RAM memory devices 42 to comprise physical integrated circuits that are also used in part as the NVRAM and RAM 152 used by the RIP 150. Engine controller 160 preferably is a microprocessor or microcontroller, and may well be resident within ASIC 44 (see FIG. 1).

Engine controller 160 is also in communication with an optically coupled toner "gas gauge sensor" 172, via an electrical conductor 174. Engine controller 160 is also in communication with the memory device 144 that is mounted to the cleaner housing sub-assembly 130 of the print cartridge 100 (see FIG. 2). This interface between engine controller 160 and the memory device 144 is preferably via a two-wire electrically conductive path 176.

On FIG. 3, the toner reservoir 112 is depicted diagrammatically by the terminology "toner sump." FIG. 3 also diagrammatically shows a "toner wheel" 170 having a shaft that protrudes through the toner sump 112. The operations of toner wheel 170 and its associated optical coupler 172 are described in detail in U.S. Pat. No. 5,634,169 (assigned to Lexmark International, Inc.), which is incorporated herein by reference in its entirety. In general, the optical coupler 172 outputs electrical pulses indicative of wheel position along electrical conductor 174 upon every single rotation of the toner wheel 170. The toner wheel 170 turns in conjunction with the paddle wheel (not shown), which stirs the toner material and tends to drive that toner material into the developer unit.

In addition to counting the pulses that travel along electrical conductor 174, the engine controller 160 and the toner wheel 170 are also designed to determine how much toner material remains within the toner sump (or reservoir) 112. This feature is described in detail in U.S. Pat. No. 5,634,169. By analyzing the information provided by the toner wheel 170, it is possible to create a "gauge" of discrete steps that give a reliable indication as to the actual amount of toner material remaining within the toner reservoir 112 as the toner begins to empty from that reservoir. The gauge of discrete steps of remaining toner material is also referred to herein as a "toner gas gauge," which uses a "gas gauge toner sensor" ("GGTS") that indicates, after a certain amount of the toner material has been dispensed from the toner reservoir 112, the actual amount of remaining toner in the reservoir in discrete steps that are indicative as to the amount of grams of remaining toner material. Thus, FIG. 3 illustrates how a sensor may be configured to determine how much toner remains in the toner reservoir which, in turn, can be used to calculate when the fuser wiper 210 should be replaced. Of course, other criteria may be used to determine when the fuser wiper should be replaced and the present invention may be implemented without the use of a toner sensor.

The memory device 144 may comprise a Dallas Semiconductor, Inc. integrated circuit, part number DS2432. Since the above-described memory device 144 is a secure memory device, it can be used to permanently record certain information about the status of the print cartridge and/or the usage of the printer and the print cartridge that cannot be later altered by a user, or anyone else for that matter. This feature is very useful in non-reusable cartridges since the incremental amount of toner that has been consumed by the printer using a particular print cartridge can be determined and stored in the EPROM. In this manner, fuser wiper replacement intervals may also be calculated based upon toner usage.

On the other hand, if it is desirable to be able to write data multiple times into the memory device 144, then an EEPROM-type device may be more suitable. As an alternative, memory device 144 could encompass both an EPROM chip (e.g., at reference numeral 146) and an EEPROM chip (e.g., at reference numeral 148), or a hybrid chip that includes certain memory elements of each type on a single substrate.

Figure 4:
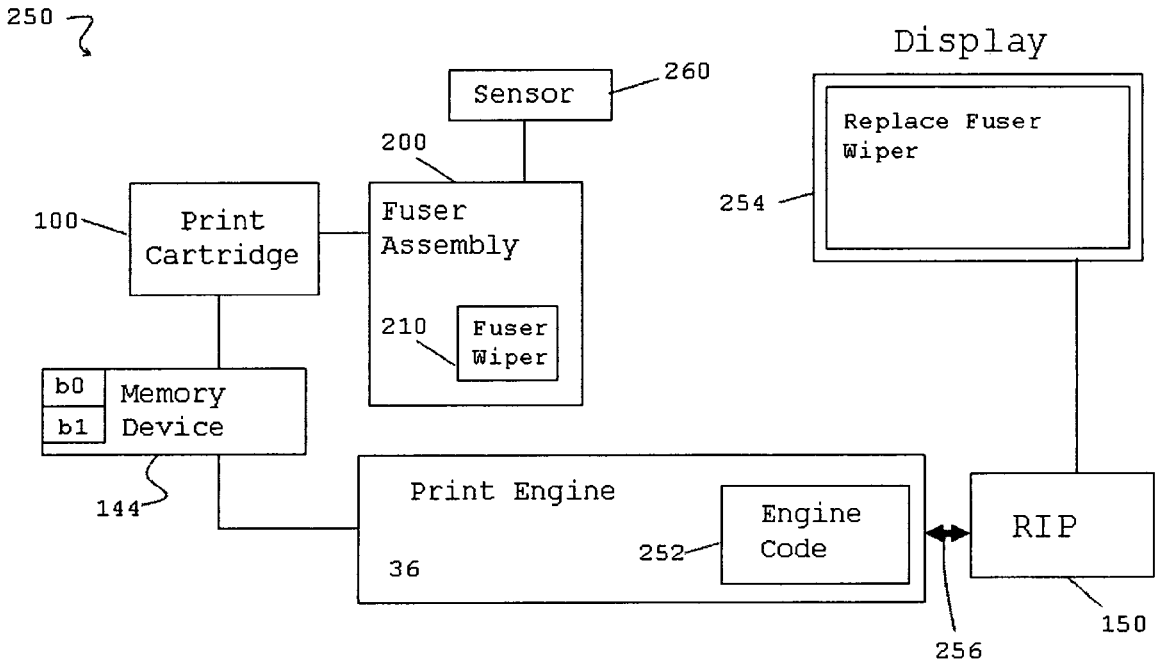
FIG. 4 is a block diagram of a system for signaling user replacement of a fuser wiper according to one embodiment of the invention.

Having shown the various components and subsystems of image forming device according to the invention, FIG. 4 illustrates the basic components of a system, denoted generally as 250, for signaling user replacement of a fuser wiper according to one embodiment of the invention. As shown, system 250 includes a print cartridge 100 in operative communication with fuser assembly 200 such that media having toner deposited therein may pass to fuser assembly 200. Fuser assembly 200 is seen to include a replaceable fuser wiper 210 which should be replaced at specified intervals in order to prolong the life of the fuser assembly 200. A memory device 144 is provided and used to store information about the print cartridge 100 and/or the printer 10 and/or the history of one or both. Of course, memory device 144 may be used to store other types of information.

Memory device 144 may be configured as an integral chip on print cartridge 100 which may be utilized in order to enable a "replace fuser wiper message" function or other similar type of notification according to the invention. In one particular embodiment, memory device 144 is used to store at least two indicators as represented by bits "b0" and "b1". Thus, one bit "b0" may be used to indicate to the print engine 36 that it should display a message at the beginning of life of print cartridge 100 and the other bit "b1" may be used to indicate that a message be generated at some specified time during the useful life of print cartridge 100. The value of these bits may be specified depending upon cartridge type and may be programmed at cartridge manufacture.

Once the print engine 36 causes a notification to be sent, the bit for that specific point in the cartridge's life may be changed by the print engine 36 to keep the message from being sent again. The capacity of the cartridge 100 may also be specified in the memory device 144 and used by the print engine 36 to help determine the specified point when to send the message.

As shown, print engine 36 has engine code 252 or "process logic" which provides the operational control portion of the print engine 36 that enables the "replace fuser wiper message" function as described herein. Thus, the engine code 252 can be adapted to first determine if a replace fuser wiper message at the beginning of cartridge life is specified for the print cartridge 100 by examining the value of bit "b0" in the memory device 144. If the "b0" bit indicates that a message should be displayed, a notification may be sent by the print engine 36 directing the RIP 150 to display a "Replace Fuser Wiper" message on operational/display panel 254. Next, the engine code 252 may re-write the value of "b0" indicating that the message has been sent.

The message at some specified later point of the print cartridge's life may be handled in a similar manner. Engine code 252 may first determine if a replace fuser wiper message at some specified point of cartridge's life is specified for the print cartridge 100 by examining the value of bit "b1" in the memory device 144. If bit "b1" indicates that a message should be displayed, engine code 252 may first determine if that specified point in cartridge life has been exceeded and, if so, a notification will be sent directing the RIP 150 to display a "Replace Fuser Wiper" message on the Display 254. The engine code 252 may then re-write the value of "b1" indicating the message has been sent. The value of "b1" after the message has been sent is the same as it would be in a memory device 144 that did not specify that this message be displayed at all.

Thus, the present invention provides a means of notifying a user that the fuser wiper should be replaced. This can be done originally when the print cartridge 100 is first inserted into the printer and/or at a later time as specified by the memory device 144. For example, using the RIP/engine interface 256, the print engine 36 may send a notification message to the RIP 150 (such as, for example, a "Replace Wiper Message Notify") when a new print cartridge 100 is inserted into the printer 10 or when the print cartridge 100 otherwise indicates the need to post a "Replace Fuser Wiper" or similar message. When the RIP 150 receives this notify, it may set a flag in NVRAM (indicating that the printer is in a state requiring replacement of the fuser wiper) and enter an Intervention Required (IR) state (i.e., discontinue printing), posting a message to the operational/display panel 254. The message may take the form of the following notice to a user:

Replace Wiper then press GO

Pressing the GO button (not shown) on the operational/display panel 254 may cause the RIP 150 to post the following message to the operational/display panel 254 (while remaining in the IR state):

Wiper replaced? GO=yes STOP=no

If the user presses "GO" at this point, the RIP 150 may assume the user has replaced the fuser wiper 210. The RIP 150 may then clear the flag in NVRAM (indicating that the printer is no longer in a state requiring replacement of the fuser wiper) and exit out of the IR state. Alternatively, if the user presses "STOP" then the flag in NVRAM may not be cleared and the printer will exit out of the IR state so that the user can resume printing. This flag in NVRAM can then be read and used by the RIP 150 to post a "Replace Fuser Wiper" message to the display 254 at a later point in time, if appropriate (for example, if the user turns on the printer while the printer is in a state requiring replacement of the fuser wiper, as indicated by the flag set in NVRAM).

The "replace fuser wiper message" function may be further refined by using sensor 260 (in FIG. 4) to detect when the fuser wiper 210 has been replaced. Such a sensor 260 would remove the guesswork regarding whether or not the user has replaced the fuser wiper 210 as instructed, and could thereby direct the messages accordingly. Furthermore, it is contemplated that there may be times when the function may have to be disabled and, as such, the RIP 150 may be configured to accept a command that would allow support personnel to turn this feature off in the printer RIP 150. This would cause the printer RIP 150 to ignore any "Replace Wiper Message Notify" received from the print engine 36.

It should be understood that modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A method of signaling user replacement of a fuser wiper within a printer that prints using a toner cartridge having a memory device, the method comprising the steps of:

storing information pertaining to specified points when said fuser wiper should be replaced in said memory device;

a print engine of the printer retrieving said information from said memory device;

printer logic causing a notification message to be generated based on said information stored on said toner cartridge, said notification message indicating to a user that said fuser wiper should be replaced; and determining when said notification message should be generated as a function of a specified interval necessary for fuser wiper replacement, wherein said specified interval is related to a variable selected from the group consisting of: the amount of toner remaining in said toner cartridge, the type of media utilized, and a type of said toner cartridge.

2. A image forming system supporting a signaling function for notifying user replacement of a fuser wiper within a printer comprising:

a print cartridge;

a fuser assembly for receiving media upon which toner from said print cartridge has been deposited, said fuser assembly including a fuser wiper;

a memory device for storing print related information;

a print engine communicably coupled to said print cartridge; and process logic for causing said print engine to read said information from said memory device and for generating a notification message to a user indicating the fuser wiper should be replaced at some specified point in the print cartridge's life, wherein said process logic determines whether said print cartridge supports a replace fuser wiper message function.

3. An image forming system supporting a signaling function for notifying user replacement of a fuser wiper within a printer, comprising:

a toner cartridge having a memory device storing information pertaining to specified points when said fuser wiper should be replaced;

a fuser assembly for receiving media upon which toner from said toner cartridge has been deposited, said fuser assembly including said fuser wiper;

a print engine communicably coupled to said toner cartridge;

process logic for causing said print engine to read said information from said memory device and for generating a notification message to a user indicating the fuser wiper should be replaced; and a display operably coupled to said process logic and adapted for graphically displaying said notification message to a user, wherein said process logic determines the appropriate time for generating a notification message as a function of specified intervals necessary for fuser wiper replacement, and wherein said specified intervals are related to a variable selected from the group consisting of: the amount of toner remaining in a toner cartridge, the type of media utilized, and the type of toner cartridge.

* * * * *